United States Patent [19]

Patterson

[11] 4,087,576

[45] May 2, 1978

[54] GREETING CARD AND ORNAMENT

[76] Inventor: Michael P. Patterson, 11701 West River Hill Dr. No. 206, Burnsville, Minn. 55337

[21] Appl. No.: 685,820

[22] Filed: May 12, 1976

[51] Int. Cl.[2] ..... B65D 65/28

[52] U.S. Cl. ..... 428/8; 40/411; 46/1 L; 229/92.8; 428/3; 428/43

[58] Field of Search ..... 428/3, 7, 8, 9, 13, 428/43, 11, 15, 16, 28; 40/124, 128; 229/92.8; 46/1, 35–37, 157, 1 L

[56] References Cited

U.S. PATENT DOCUMENTS

| | | | |
|---|---|---|---|
| 682,519 | 9/1901 | Bartholomew | 46/157 X |
| 1,066,769 | 7/1913 | Waddington | 46/157 |
| 1,096,147 | 5/1914 | Beard | 46/157 |
| 1,393,213 | 10/1921 | Gilbert | 428/43 X |
| 1,823,241 | 9/1931 | Weindel, Jr. | 428/7 |
| 2,256,584 | 9/1941 | Steeple | 428/7 |
| 2,347,561 | 4/1944 | Howard et al. | 35/1 |
| 2,498,467 | 2/1950 | Webber | 428/3 X |
| 2,613,140 | 10/1952 | Hart | 428/11 X |
| 2,616,199 | 11/1952 | Robins | 428/43 X |
| 2,924,036 | 2/1960 | Rossiter | 40/128 X |
| 3,236,368 | 2/1966 | Eisen | 428/13 X |
| 3,440,747 | 4/1969 | Oliver | 40/126 A |

*Primary Examiner*—George F. Lesmes
*Assistant Examiner*—Henry F. Epstein
*Attorney, Agent, or Firm*—Dugger, Johnson & Westman

[57] ABSTRACT

A greeting card which includes a folding, three-dimensional hanging ornament that can be punched out of panels of the card while the greeting itself can be separated for reference and saving, and the ornament may be hung for decorative purposes. The combination provides an attractive remembrance and combines the usefulness of a three-dimensional decoration and with the ability to preserve the greeting in card form.

3 Claims, 4 Drawing Figures

GREETING CARD AND ORNAMENT

BACKGROUND OF THE INVENTION

1. Field of the Invention

The present invention relates to mailable cards that can be used for greeting and which include three-dimensional punch out ornaments that can be used for hanging ornaments.

2. Prior Art

In the prior art, a greeting card-ornament combination is shown in U.S. Pat. No. 2,616,199. This comprises a single sheet of paper forming the greeting card that is formed into an ornament for hanging, and does not permit the preservation of a greeting verse as well as use as an ornament. Another type of three-dimensional decorative greeting card is shown in Design Pat. No. 164,323. This design patent shows an arrangement that apparently can be folded flat for mailing and assembled into a three-dimensional shape for hanging.

A snap-open type greeting card device is shown in U.S. Pat. No. 3,134,708, and this encompasses several panels that are folded together and can be snapped open into a shape such as a house, or a triangular cross section pyramid.

U.S. Pat. No. 2,696,690 also shows a three-dimensional greeting card in several embodiments utilizing a large number of panels for forming the greeting card and which permit the card to stand by itself and provide a three-dimensional presentation. It does not include an ornament that can be hung, however, and uses the integral parts of the card for the decoration. Also it is well known that combination of greeting cards and other objects such as a child's bib can be made. Such a structure is shown in U.S. Pat. No. 2,461,430. Greeting cards that stand or have stand members are also known as shown in U.S. Pat. No. 481,173.

Other examples of similar prior art include U.S. Pat. Nos. 930,108, 286,642 and 2,205,262.

SUMMARY OF THE INVENTION

The present invention relates to greeting card and ornament combination wherein a multi-panel greeting card has one card panel including a greeting or verse that is separable from the other card panels for reference and preservation, and further includes a punch-out ornament on the other panels that can be made into a three-dimensional object for hanging. The card is arranged so that instructions and signature can appear on the inside panel which is visible when the outer cover panel is opened, and the cover panel may be removed and kept separate from the ornament when the ornament has been punched out and assembled.

The arrangement permits a recipient to read the greeting verse, open the card and find a signature as well as instructions for assembly of the ornament so that it is immediately realized that the card can be made into an ornament. The ornament itself is punched out along slit lines with small attachment points for keeping the ornament retained in the card until manually removed for assembly. The ornament then can be hung in a convenient manner for display purposes.

DESCRIPTION OF THE PREFERRED EMBODIMENT

Figures 1, 2, 3, 4:
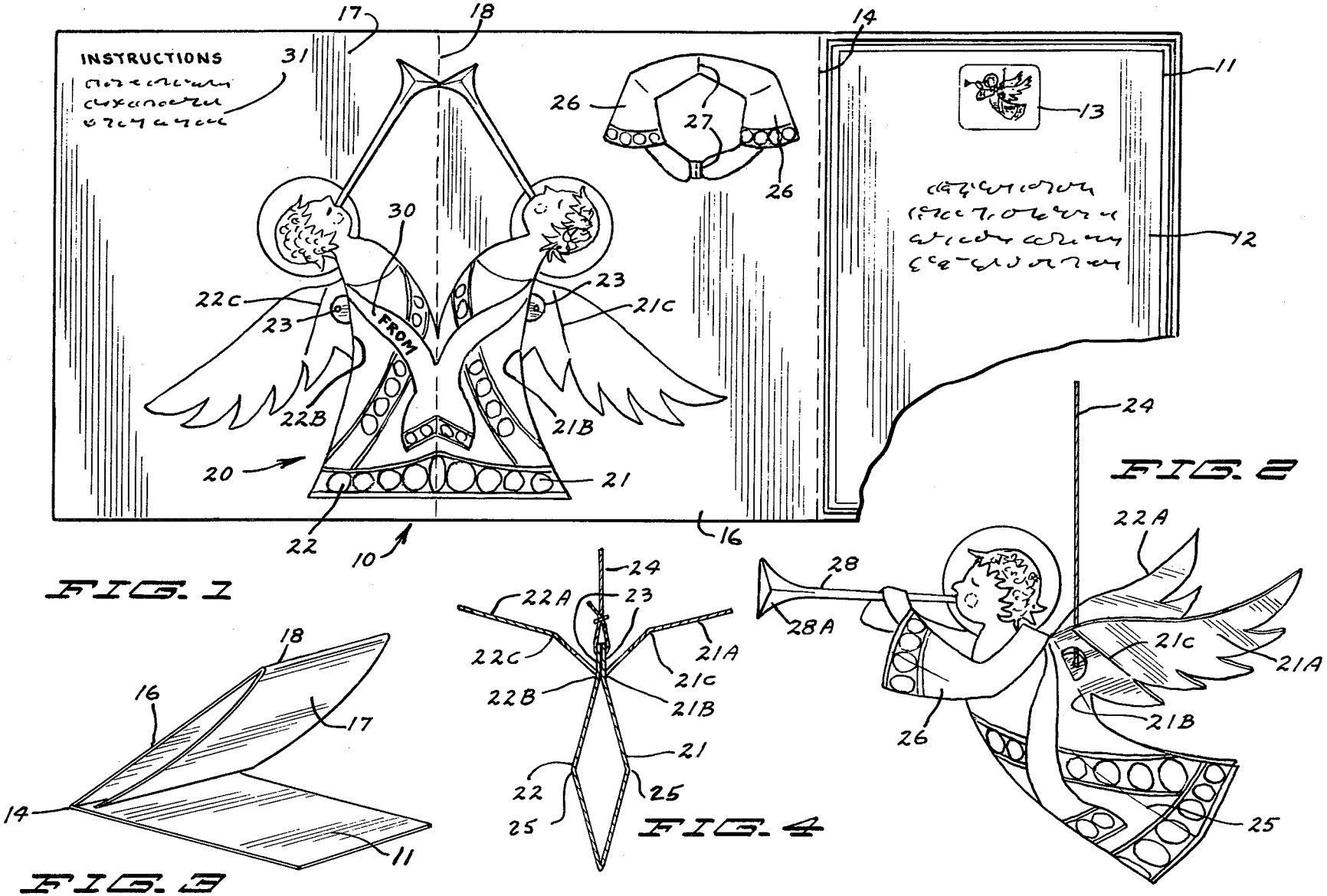
FIG. 1 is a flat layout of a greeting card and ornament combination made according to the present invention.
FIG. 2 is a perspective view of the three-dimensional ornament after it has been punched out and assembled.
FIG. 3 is a perspective view of the card of FIG. 1 shown partially opened to illustrate the way it is folded for mailing.
FIG. 4 is a vertical sectional view through the mid-portions of the body of the ornament of FIG. 2.

FIG. 1, the combined greeting card and ornament illustrated generally at 10 is made up of a front or cover panel 11 that has a front face 12 on which a written greeting message is represented. The card is made of suitable card paper stock having some rigidity, but which is bendable and/or foldable. In addition, an illustration 13 of the ornament that is included with the card is shown in its assembled form. The front face also can have a place for signature of the sender, so that when the front card panel 11 is severed from the rest of the card along a perforated junction edge 14 the front panel can be kept as a remembrance and may have the signature of the sender on it. The front panel 11 is joined with a second card panel 16 along the perforated edge 14. The second card panel 16 is joined to a third card panel 17 along a scored fold line 18. The card is folded so that the front card panel 11 forms the outer cover of the card, and the third card panel 17 is folded along the scored line 18 so that when the outer panel 11 is closed the face of the third card panel 17 will form the inner page or surface of the card as shown in FIG. 3.

An ornament configuration illustrated generally at 20 is cut or slit along its outline, and small tear-away junctions are left to connect the ornament to the panels 16 and 17 so that the ornament 20 will remain in position. The ornament 20 as shown is an angel, but can be any three-dimensional object or creature desired. The ornament 20 as shown has two mirror image half body portions 21 and 22, respectively that are joined along the score fold line 18, and when punched out of the card panels, the line 18 where the side body portions join will fold easily so that the two portions 21 and 22 can be folded together. Thus, where two or more ornament sections join along a fold line, the ornament fold line should be located along the card panel fold line. Small tabs 23 are also formed at the top edges of the ornament side body portions adjacent where the wings of the angel are attached and these tabs are slit and can be punched out of the paper stock so they are separated from the wings. The tabs 23 can be placed together and held together with a string 24 that is tied through aligning apertures. The wings can be folded out, along suitable fold lines and the angel body itself can be made into a three-dimensional body by squeezing the top and the bottom edges together so that the body portions separate along score lines indicated at 25. This separation of the body side panels and the formation of the wings is shown in FIG. 4.

Additionally, punch-out arms of the angel indicated generally at 26 can be provided on the second panel 16, which forms the back panel of the card when it is mailed. As shown, the arms 26 are formed as a pair that can be folded along provided score lines 27, and then fastened in place immediately behind the neck of the angel as shown in FIG. 2 with the hands folded over the trumpet portion 28.

The sender's signature line can be provided as indicated at 30 on the third panel 17, and thus on the panel face that forms the inner page of the card when folded, as shown in FIG. 3. In addition, instructions written at a location indicated at 31 are readable as soon as the front panel 11 is opened, and this will indicate immediately that the figure represented can be punched out and assembled into a three-dimensional hanging ornament.

The front panel 11 is easily removed and kept as a remembrance, and the three-dimensional ornament also can be hung and used as a decorative ornament or remembrance of the sender as well.

It should also be noted that the end bell 28A of the trumpet 28 can be puffed out or separated along scored fold lines that are shown in FIG. 2 to give it a three-dimensional effect when the two sections are placed together. The tabs 23 will remain tied together even though the wings 22A and 21A are folded out along the junction lines 22B and 21B respectively where they attach to the main portions of the body of the angel. The fold lines indicated at 21C and 22C can be used for spreading the wings in the desired manner.

Other three dimensional ornament figures such as birds or the like can be used in the same manner. The two halves of the body are formed on opposite sides of the scored fold line 18 that joins the second and third card panels, so that the halves of the ornament can be folded together, and the opposite or top edges fastened with the tabs 23. Then the three-dimensional effect is caused by having additional score lines in the midportions of the body so that the two body portions can be spread apart to form a tubular body and the midportions of the body will remain apart while the top and bottom edges of the body will remain close together. Of course, the bottom edge as shown is along the scored fold line 18 of the card, while the top edge is held together by the string 24 holding the tabs 23 assembled.

The representation of the angel can be replaced with representations of birds or other creatures which can be formed in two mirror image side panel postions folded along a common junction-fold line and bent out to form a three-dimensional body by squeezing along the top and bottom edges to separate the midportions of the body and thereby making it tubular along its longitudinal axis.

What is claimed is:

1. An ornament greeting card combination, including a first card panel carrying a greeting, second and third card panels joined to each other along a fold line and said second being detachably secured to the first card panel along a perforated tear line and foldable relative thereto, a punch-out ornament included on the second and third card panels, said ornament comprising a winged body represented by two mirror image initially flat side panels, one side panel formed in each of said second and third card panels and said side panels being joined to each other along said fold line which defines one edge of said ornament, said flat side panels each including a body section and a wing section, a separate second fold line between each body section and its attached wing section, and a separate tab defined adjacent each of said second fold lines and being formed by slit lines to permit punching out the separate tab from each wing section which remains attached to the respective body section along the respective second fold line, so that the tabs thereby protrude from each of the wing sections, said tabs being positioned contiguous to each other when the ornament is assembled, and including means to tie a string to both of the tabs to hold the tabs together and thereby to hold adjacent edges of the body sections together and suspend the ornament, said wing sections being foldable outwardly from the tabs and the respective body sections along said second fold lines to extend in opposite directions from the body sections and wherein one side panel of the ornament includes means to provide a sender's signature carried by the ornament when assembled and on a surface readable when the first panel of the folded card is opened before the ornament is punched out.

2. The combination of claim 1 and means to provide instructions for assembly of the ornament positioned on a surface visible when the first card panel is opened.

3. The combination of claim 2 wherein said card panels are foldable so the first card panel forms a front panel, and said second card panel forms a back panel of the card, and said third panel is folded between said first and second card panels.

* * * * *

UNITED STATES PATENT OFFICE

CERTIFICATE OF CORRECTION

Patent No. 4,087,576 Dated May 2, 1978

Inventor(s) Michael P. Patterson

It is certified that error appears in the above-identified patent and that said Letters Patent are hereby corrected as shown below:

Column 4, line 4, (Claim 1, line 4), after "second" insert --panel--.

Signed and Sealed this

*Third* Day of *October 1978*

[SEAL]

*Attest:*

RUTH C. MASON
*Attesting Officer*

DONALD W. BANNER
*Commissioner of Patents and Trademarks*